US008438877B2

(12) United States Patent
Haug et al.

(10) Patent No.: US 8,438,877 B2
(45) Date of Patent: May 14, 2013

(54) KNITTING SYSTEM WITH FLATTENED GUIDE CHANNELS

(75) Inventors: Hans-Jurgen Haug, Mossingen (DE); Eric Jurgens, Bisingen (DE); Johannes Bruske, Albstadt (DE); Jorg Sauter, Albstadt (DE); Martin Wornle, Mossingen (DE); Frank Durst, Albstadt (DE); Eckard Fehrenbacher, Tubingen (DE)

(73) Assignee: Groz-Beckert KG, Albstadt (DE)

( * ) Notice: Subject to any disclaimer, the term of this patent is extended or adjusted under 35 U.S.C. 154(b) by 0 days.

(21) Appl. No.: 13/170,831

(22) Filed: Jun. 28, 2011

(65) Prior Publication Data

US 2012/0006064 A1 Jan. 12, 2012

(30) Foreign Application Priority Data

Jul. 6, 2010 (EP) ..... 10168553

(51) Int. Cl.
*D05B 15/10* (2006.01)

(52) U.S. Cl.
USPC ..... 66/115; 66/123

(58) Field of Classification Search ..... 66/117, 66/118, 123, 124, 115, 114, 116
See application file for complete search history.

(56) References Cited

U.S. PATENT DOCUMENTS

| | | | | |
|---|---|---|---|---|
| 423,244 | A | 3/1890 | Harley et al. | |
| 1,221,806 | A * | 4/1917 | Scott | 66/115 |
| 2,192,098 | A * | 2/1940 | Page | 66/123 |
| 3,667,113 | A | 6/1972 | Philip | |
| 3,712,083 | A * | 1/1973 | Slof et al. | 66/123 |
| 3,817,058 | A * | 6/1974 | Lombardi | 66/8 |
| 3,949,572 | A * | 4/1976 | Kopal et al. | 66/115 |
| 4,041,734 | A * | 8/1977 | Yoichi | 66/115 |
| 4,625,527 | A * | 12/1986 | Fukuhara | 66/123 |
| 4,681,150 | A * | 7/1987 | Fukuhara | 163/5 |
| 5,609,044 | A * | 3/1997 | Tacy | 66/115 |
| 5,901,582 | A * | 5/1999 | Hennig et al. | 66/123 |
| 6,122,938 | A * | 9/2000 | Henning et al. | 66/123 |
| 6,860,121 | B2 * | 3/2005 | Jurgens et al. | 66/123 |
| 6,892,556 | B2 * | 5/2005 | Landenberger | 66/123 |
| 7,874,183 | B2 * | 1/2011 | Fehrenbacher | 66/123 |
| 2007/0144220 | A1 | 6/2007 | Stingel et al. | |

FOREIGN PATENT DOCUMENTS

| | | | |
|---|---|---|---|
| DE | 677979 | C | 7/1939 |
| EP | 586771 | A | 3/1947 |
| EP | 1801276 | A1 | 6/2007 |
| EP | 2172584 | A1 | 4/2010 |
| GB | 505324 | | 5/1939 |
| GB | 962128 | A | 6/1964 |
| GB | 2173518 | A | 10/1986 |

OTHER PUBLICATIONS

European Search Report; EP12175984 dated Dec. 17, 2012; 4 pages.

* cited by examiner

*Primary Examiner* — Danny Worrell
(74) *Attorney, Agent, or Firm* — Fitch, Even, Tabin & Flannery, LLP

(57) ABSTRACT

A knitting device (10) comprising a needle bed (12) and knitting tools (16), wherein the needle bed (12) is designed so as to be without joints and seams in view of the configuration of its channel walls (18, 19) as well as perpendicularly to the floor (23) of the channel through the base body (20) of the needle bed (12). The channel depth of the individual guide channels (13, 14, 15) is preferably less than three times the channel width. Consequently, in particular in the case of extremely fine needle divisions, the resultant channel walls (18, 19) are robust and stable and can be subjected to a hardening or coating treatment. The reduced overall weight, the smaller friction surfaces, and the sturdier design of the knitting device enable the operation at greater knitting speeds and with greater rotational accelerations, in particular in reciprocating mode, and an overall savings of lubricants and energy.

15 Claims, 4 Drawing Sheets

16
55
58
57
53
62
56

KNITTING SYSTEM WITH FLATTENED GUIDE CHANNELS

CROSS-REFERENCE TO RELATED APPLICATION

The present application claims the priority of European patent application No. 10 168 553.5, filed Jul. 6, 2010, the subject matter of which, in its entirety, is incorporated herein by reference.

BACKGROUND OF THE INVENTION

The invention relates to a knitting system comprising a needle bed, for example in the form of a knitting cylinder, and a knitting tool, for example in the form of a needle, in particular, a latch-type needle.

Needle beds, in particular knitting cylinders such as have been known from the examples of U.S. Pat. No. 423,244B, have been fabricated in that, for example axially extending guide grooves are milled into a cylindrical base body, said guide grooves forming guide channels for knitting tools, for example needles. Another possibility for fabricating guide channels stated in the same publication is based on milling longitudinal grooves on the outside of a metal body representing a hollow cylinder, whereby strips are then inserted in said longitudinal grooves. The guide channels for knitting tools are defined between the inserted strips.

In both cases the assumption is that the depth of a guide channel is considerably greater than its width. For example, a needle cylinder with a fineness greater than E20 (more than 20 needles per inch) has a guide channel depth of 3.7 mm and a guide channel width of 0.44 m. This corresponds to a depth/width ratio greater than 8.

The idea that has so-far previously been known has met with difficulties in instances of greater degrees of fineness. In particular, in instances of degrees of coarser fineness such as E18 and less, typically cylinders with milled guide channels are being used. As a result of this, parallel-flanked guide channels in the needle cylinders are obtained. However, hardening the existing strips is difficult. At degrees of fineness greater than 18, hardening is likely to be dispensed with, which, however, can again cause problems of wear.

The design of the strips inserted in the cylinder results in an expensive manufacturing process. This applies, in particular, in instances of high degrees of fineness such as E18 and finer. However, in the case of foot breakage and a damage of the strips, a total damage of the cylinder can occasionally be prevented if individual damaged strips can be replaced.

If greater demands are made in view of accuracy, the design using inserted strips on knitting cylinders may lead to difficulties because, in fact, slightly trapezoidal guide channels may result. If, in contrast, strips are used that themselves are somewhat trapezoidal in form in order to compensate for that, the manufacture is made even significantly more expensive.

The problem of hardening a knitting cylinder has resulted in alternative designs such as those shown by publication DE 677 979, for example. The knitting cylinder schematically illustrated there with guide channels having a rectangular cross-section is segmented. Said knitting cylinder comprises an interior, non-hardened hollow cylindrical body, to which shell-shaped hardened segments are attached, said segments being provided with the needle channels.

Considering this design, there are major problems if the shell-shaped segments attached to the outside of the hollow cylindrical base body are subject to distortion while being hardened.

It is the object of the invention to provide a concept for a knitting device that makes possible a cost-effective simple fabrication featuring a reliable process and, at the same time, also meets the requirements of increased knitting speed.

SUMMARY OF THE INVENTION

The above object generally is achieved with the knitting device in accordance with the invention which comprises a needle bed with guide channels, wherein the needle depth is at least three quarter times and at most five times greater than the channel width. Preferably, the ratio of channel depth to channel width is between 2 and 3, also, preferably between 2.5 and 2.75, and in the best case, at 2.62.

In doing so, the needle bed is without seams and joints and made of the same material. There are neither seams nor joints between the channel walls and the remaining body of the needle bed, nor does the needle bed itself have any joints or seams even underneath the floor of the guide channel. In the case of a knitting cylinder, said cylinder thus consists of a one-piece body in its entire radial direction. This is not hindered by the fact that the knitting cylinder can consist of several ring-shaped elements placed next to each other in axial direction. Also, it is possible within the framework of the invention to compose the knitting cylinder of several, for example shell-shaped, sections that abut against each other along axially extending joints. In any event, there is a structural continuity in radial direction.

Furthermore, the knitting device comprises knitting tools that are arranged so that they can be axially shifted in the guide channels and comprise at least one foot projecting from the guide channel. All of the knitting tools may have the same configuration. For example, they may be latch-type needles, slider needles or the like.

In a preferred embodiment, the shank cross-section of the knitting tool matches the channel cross-section, in which case the shank cross-section of the knitting tool is minimally smaller, in particular as regards its width, because the knitting tool is movably arranged in the guide channel. The shank cross-section of the knitting tool thus largely matches the channel cross-section. The channel walls do not or not substantially project beyond the shanks of the knitting tools. Due to the shallow channel depth, the resultant knitting cylinder displays a substantially lower weight compared with conventional knitting cylinders. In addition, the weight of the needles moving in the guide channels is almost half of the weight of the prior art needles, this potentially resulting in a savings of weight regarding the knitting device by up to 20%. Inasmuch as the weight saving starts, in particular, on the outside diameter, this results in a substantial reduction of the mass moment of inertia of the knitting cylinder. This is of importance, in particular, for the increase of the working speed of knitting machines, when said knitting machines perform a frequent reversal of rotation during operation, as is the case in reciprocating back-and-forth mode, for example, in the production of patterned goods.

In addition to the aforementioned considerable reduction of weight, considerably less raw material is required for the manufacture of a knitting system in accordance with the invention than would be required for the manufacture of a prior art knitting system. Taking into consideration increasingly scarce raw material resources, the invention reduces the overall cost of a knitting system.

The drastic reduction of the channel depth of the guide channel has far-reaching technical consequences. Due to the reduced channel depth and the equally reduced strip height of the corresponding knitting tool, significantly reduced surfaces of contact between the knitting tools and the channel walls result. This reduces friction, in particular static friction, that needs to be repeatedly overcome in the knitting process. Reduced static friction ultimately leads to reduced cam assembly wear and to lower driving forces as well as, finally, also to a reduced need of oil.

Considering a preferred embodiment of the guide channel, the contact surface between the knitting tool and the guide channel is further reduced because at least one recess is provided in the guide channel. The recess may be provided in a channel wall or in the floor of the guide channel. In doing so, at least one recess is arranged in the guide channel outside the region where the knitting cam impinges on the foot of the knitting machine needle. The length and the position of the recess are determined in such a manner that at least two spaced apart points of the knitting tool interact at all times with the guide channel during the entire stitch forming process. This is independent of whether the recess is arranged in a channel wall or on the floor of the guide channel. Preferably, the recess is located between at least to abutment points. It is possible to provide more than one recess, or provide one recess, with at least one discontinuity on the guide channel. Any discontinuity of a recess may form an abutment point for the knitting tool. The length of the recess corresponds at least to the path traveled by the knitting tool during the movement from the retracted position to the front-most driven-out position of the knitting tool. The length of the recess is at most as long as the length of the portion of the knitting tool that is accommodated in the retracted position in the guide channel, minus the path traveled by the knitting tool from its retracting position to its front-most driven-out position, minus the length of the abutment points.

In another exemplary embodiment of a knitting system in accordance with the invention, the recess may be provided in the knitting tool itself. In this case, the back and/or one flat side of the knitting tool have at least one cutout.

Regardless of whether the recess is arranged on the knitting tool or in the guide channel, the recess may be disposed to have the form of a rectangular pocket. This pocket then has a plane flat bottom arranged parallel to the floor of the guide channel or parallel to the back of the knitting tool, or parallel to the channel walls or offset with respect to the flat sides of the knitting tool. It is also possible for the recess to have a concave bottom in the shape of a section of a circular arc. The recess then has the shape of a cylindrical section. The recess may comprise up to 90% of the floor or the guide channel or of the back of the knitting tool or a channel wall or a flat side of the knitting tool, in which case it is ensured that the knitting tool abuts, during the stitch forming process, against at least two points of the guide channel (channel wall, channel floor) and thus ensures precise, secure guiding.

The suggested geometric configuration of the knitting device in the case of a circular knitting machine, in particular the novel geometric configuration of the knitting cylinder, enables efficient and improved production processes. For example, the guide channels displaying shall channel depth can be easily and precisely produced by machining or by other ablation processes. Also, hardening processes to be performed following the fabrication of the guide channels or even coating processes can be performed easily and effectively. In particular, the coating of the channel walls with good quality is successful thanks to the ratio of channel depth/channel width that has been clearly reduced compared with prior art. Due to the ratio of channel depth/channel width that has been clearly reduced compared with prior art, it is possible to coat and harden the entire surface of the knitting cylinder, in particular its guide channels, including its channel walls and its channel floor.

Furthermore, it is possible to concentrate hardening and/or coating in those regions of the channel walls that are subjected to high friction loads during operation. In particular, it is possible to coat the complete region of the needle channel, i.e., also its floor, and to increase its hardness.

Preferably, the knitting tool of the novel knitting device comprises a full shank with one or more feet. In the vicinity of the foot, there is at least one recess. Preferably, this recess has the form of an elongated indentation whose length is a multiple of its depth. In this manner, regions are defined between the foot and the shank, said regions displaying a certain elasticity, optionally also a torsional elasticity, and, in any event, reduce the susceptibility of the knitting tool to cracks and breakage.

Additional details of advantageous embodiments of the knitting device in accordance with the invention are the subject matter of the drawings, the description or the claims.

DETAILED DESCRIPTION OF THE INVENTION

Figure 1:
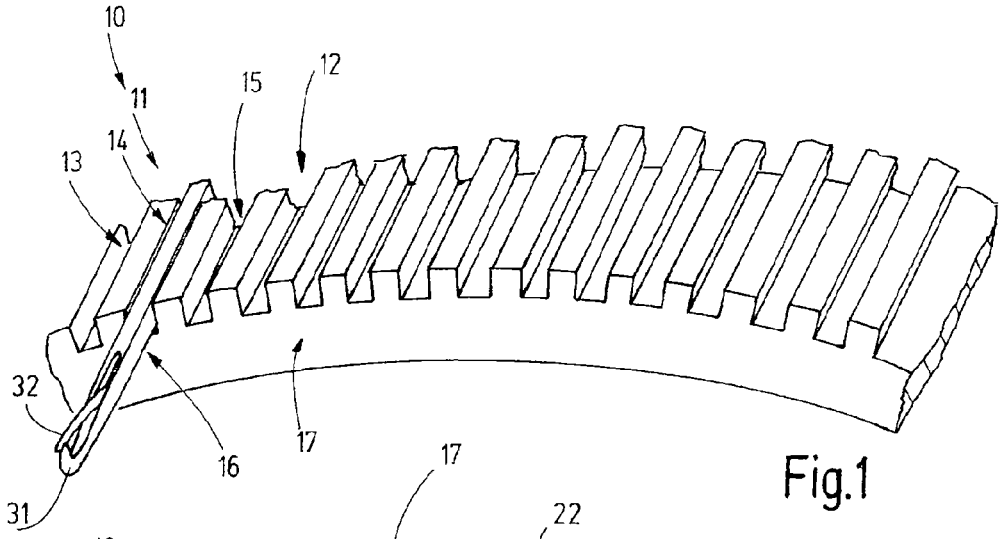
FIG. 1 is a schematized detail of a representation of the principle of a knitting device in accordance with the invention.

FIG. 1 shows a knitting device 10 using the example of a circular knitting device 11 comprising a needle bed 12 with a plurality of guide channels 13, 14, 15, etc., as well as knitting tools. In lieu of the knitting tools arranged in each guide channel 13, 14, 15, etc., FIG. 1 shows one needle 16 that is configured, for example, as a latch-type needle.

Figure 2:
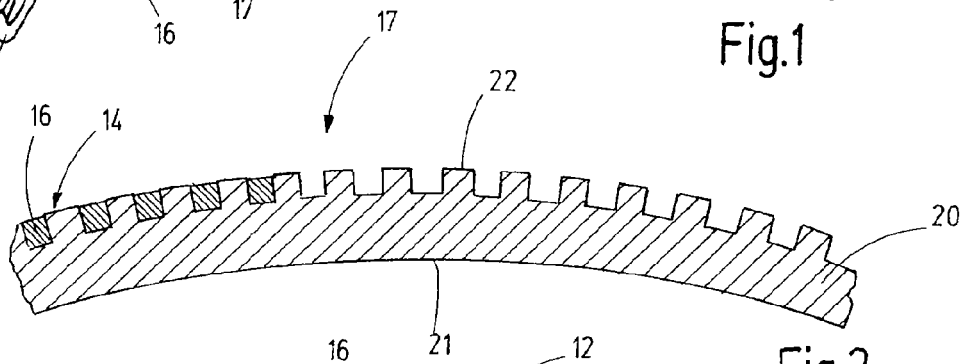
FIG. 2 is a schematized sectional representation of a detail of the knitting device as in FIG. 1.

In this instance, the needle bed 12 is represented, for example, by a knitting cylinder 17 that has the basic form of a hollow cylinder. Each of FIG. 1 as well as FIG. 2 shows a detail of this knitting cylinder. Preferably, said cylinder consists fully of one piece, i.e., a one-piece component that has no seams and no joints. However, it is also possible, to segment the knitting cylinder 17 or, otherwise, the needle bed 12 (such as, e.g., a dial, a sinker ring or the bed of a flat-bed knitting machine), in which case the individual segments are again disposed to be in one, seamless and jointless piece.

Figure 3:
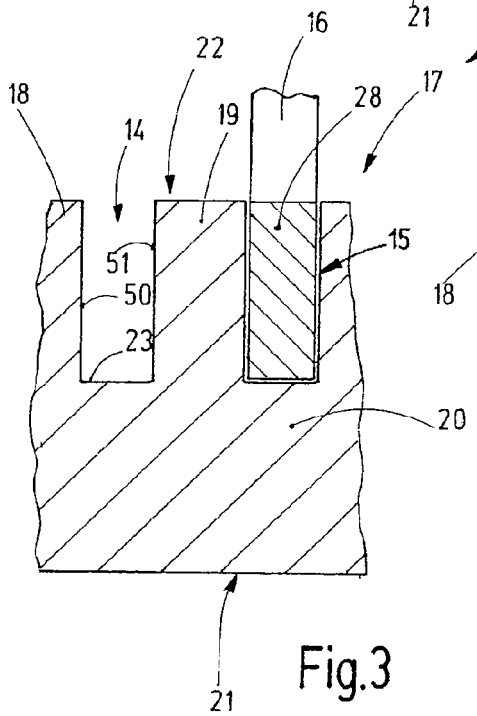
FIG. 3 is a representation, on another scale, of the knitting device as in FIG. 1.

The seamless and jointless design is particularly obvious from FIGS. 2 and 3. As can be seen in the example, each guide channel 14 is delimited in radial direction by two flat sides 50, 51, said sides delimiting the channel walls 18, 19. The flat sides 50, 51 face each other, whereby their distance from each other defines a width 24 of the guide channel 14. The channel walls 18, 19 are a one-piece component of a base body 20, said base body being configured, in the present exemplary embodiment, as a ring-shaped hollow cylinder and extending from an interior circumferential surface 21, said surface being radially freely exposed to daylight, up to a radially outward side—broken up by the guide channels 14, 15—of an exterior circumferential surface 22. The exterior circumferential surface 22 is formed by the front sides of the channel walls 18, 19 and by the flat sides 50, 51 of the channel walls 18, 19, as well as by the floor 23 of the guide channel 14, said channel connecting the two flat sides 50, 51. There are no seams, joints, dividing surfaces or the like, whatsoever between the channel walls 18, 19 and the interior circumferential surface 21 (i.e., complete radial integrity of the base body 20 is given).

In addition, the guide channel 14 has a floor 23 that, preferably, is configured as a flat surface. Between the floor 23 and the flat sides 50, 51 of the channel walls 18, 19, there are not dividing joints, seams or the like. Likewise, there is not joint or seam between the floor 23 and the interior circumferential surface 21. The material between the floor 23 and the interior circumferential surface 21 is disposed so as to be continuous. Consequently, the needle bed 12—here in the form of a knitting cylinder 17—consists of one piece.

Figure 4:
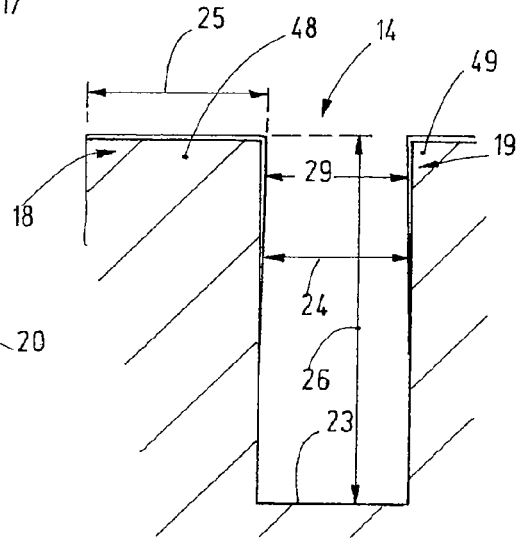
FIG. 4 is a detail of the needle bed, in a cross-sectional representation, on another scale.

As is explained hereinafter using the guide channel 14 as an example, the guide channels display a special dimensional ratio. The channel width 24 shown in FIG. 4 is preferably slightly smaller than the thickness 25 of the adjacent channel wall 18 that is also shown in FIG. 4. Preferably, all the channel walls 18, 19, etc., have matching thicknesses. In addition, all the guide channels 14, 15, etc., preferably have matching channel widths 24 as well as channel depths 26. Preferably, the channel depth 26 is in a range of three fourths to at most five times the channel width 24. Preferably, the channel depth 26 is in the range of 2 to 3 times the channel width 24. In the preferred case, the ratio between channel depth and channel width is at 2.6. This applies, correspondingly, to the width and the height of the shank 28 of the knitting tool 16, as is obvious from FIG. 3. Preferably, the shank 28 fits the guide channel 15 so as to fill it leaving minimal tolerance. To this extend, the guide channel 15 and the shank 18 have matching cross-sections excluding said tolerance.

The said dimensional ratios enable the application of a wear-minimizing coating 29, in particular on the flat sides 50, 51 of the channel wall 18, 19. The front sides of the channel wall 18, 19 are freely accessible for a coating process. The wear-minimizing coating may be a metallic or ceramic hard substance layer such as, for example, a DLC (diamond-like carbon), TiN or TiC layer or another friction-minimizing or wear-minimizing layer. Preferably, this layer has a thickness that varies across the guide channel depth. For example, the layer thickness is the thickest at the end of each flat side 50, 51 of a channel wall 18, 19, said end being the farthest away from the floor 23.

The said dimensional ratios enable the coating of the needle bed 12 by means of a PVD (physical vapor deposition) or a CVD (chemical vapor deposition) process, whereby coating can be achieved in particular in the guide channels 13, 14. This is also true of greater degrees of fineness such as E18 and finer that, in instances of deeper geometric configurations of grooves as are used in prior art, persistently defy any adequate coating.

Figure 5:
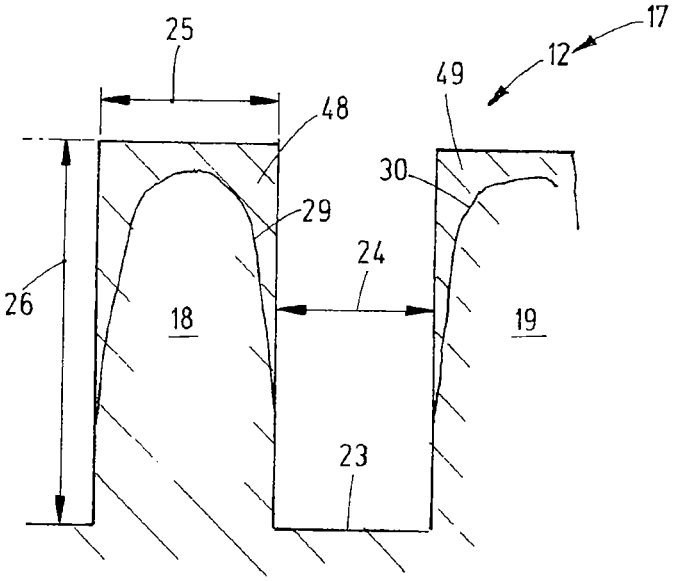
FIG. 5 is a modified embodiment of the needle bed with partially hardened channel walls.

As is shown by FIG. 5, the exterior region of the channel walls 18, 19, etc., of the needle bed 12 or the knitting cylinder 17 can be selectively hardened. For example, a thermal treatment with hardening of the ends of the flat sides 50, 51 of the channel walls 18, 19—said ends being the farthest away from the respective floor 23—is successful, in particular, without substantial distortion of the channel walls 18, 19. The flat sides 50, 51 are subject to wear during the back-and-forth movement of the knitting tools 16. Considering a knitting system in accordance with the invention, this wear can be reduced significantly by coating and hardening, respectively, the flat sides 50, 51 and thus leads to a knitting system that operates with great precision over a long period of time. The borders 29 30 are schematically shown in FIG. 5, in which case hardened material is adjacent less hardened or not hardened material.

The coating 29, as well as its hardening, may be restricted, in particular, to the zones or edges 48, 49 of the channel walls that are at a distance from the floor 23. There, in particular the transverse or torsional forces acting on the knitting tool are carried away, said forces being transmitted, e.g., by the cam assembly as tilting forces to the foot of the knitting tool. Hardening and/or coating of the edges 48, 49 counteracts any wear occurring in particular at that location and ensures good guiding of the knitting tool 16, despite the reduced shank height H (FIG. 6).

Figure 6:
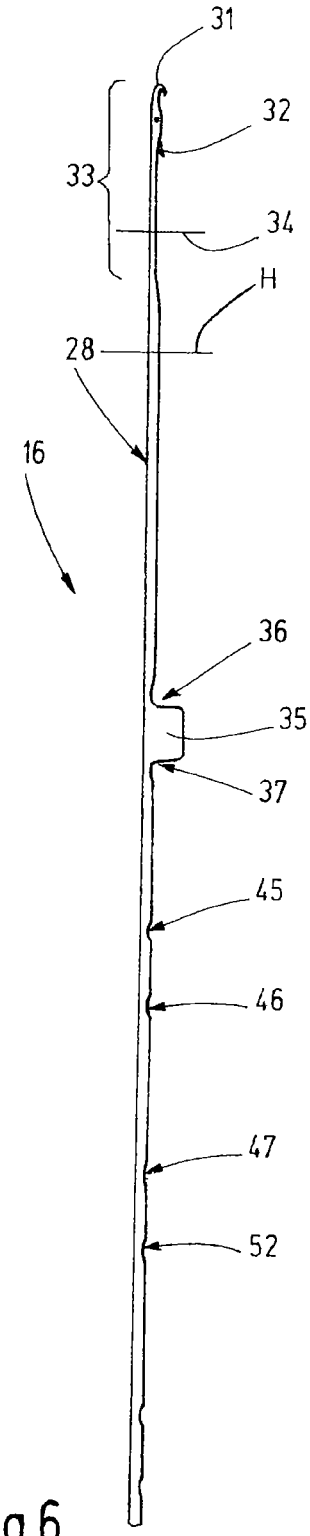
FIG. 6 is a side view of a knitting tool.

FIG. 6 illustrates a knitting tool, namely, a needle 16 in this exemplary embodiment. This knitting tool is a full shank tool with an elongated straight shank 28 that is provided with a hook 31 on one end. Said hook may be associated with a pivotally supported closing element 32. The hook 31 and the closing element, the latch 32, belong to a stitch-forming section 33 that has a measured height 34 which is smaller in the direction of the channel depth 26 than the shank height H. Extending from the stitch-forming section, this shank height H is largely constant along the entire length of the shank 28.

Figure 7:
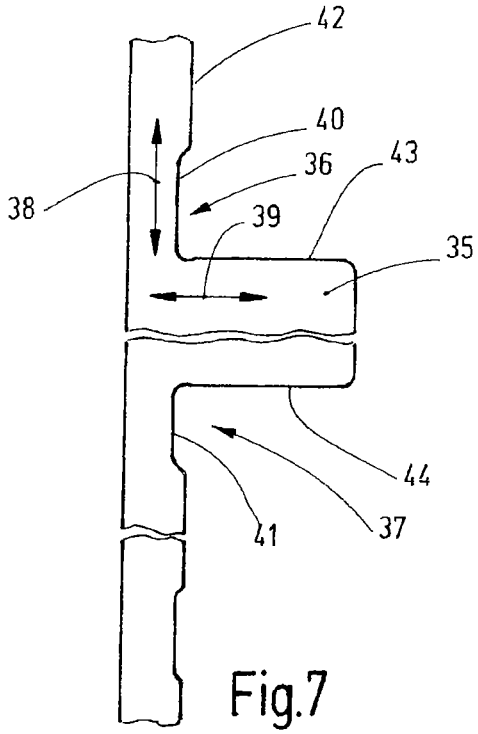
FIG. 7 is a detail, in schematized side view, of the knitting tool as in FIG. 6.

As can be seen in FIG. 3, a foot 35 extends from the shank 28 that, preferably, has a rectangular cross-section viewed in radial direction of the knitting cylinder 17. At least one side of the foot, preferably both sides of said foot, is provided with recesses 36, 37. They directly adjoin the foot 35. As is shown by FIG. 7, the recesses 36, 37 are preferably the same among each other and are symmetrical relative to the foot 35. Preferably, the recesses 36, 37 are substantially longer in longitudinal direction 38 than in foot direction 39. Preferably, the length measured in longitudinal direction 38 is more than twice to at most 10 times to 20 times the depth of the recess 36, 37 measured in foot direction 39. In addition, each recess 36, 37 preferably has a straight bottom and rounded transition regions toward the needle upper side 42 and the foot edges 43, 44, respectively.

It is possible to provide additional such recesses 45, 46, 57, 52, etc., distributed over the length of the shank 28. These recesses may be deliberately provided for reducing weight and vibrations. They may also remain as relics if, for example, the needle 16 had originally several feet, each of said feet having been flanked by corresponding recesses 36, 37, 45, 46, 47, 52, and if individual such feet have been removed, as is common in order to allocate the needles of a knitting cylinder to different cams of the cam assembly.

Figure 9:
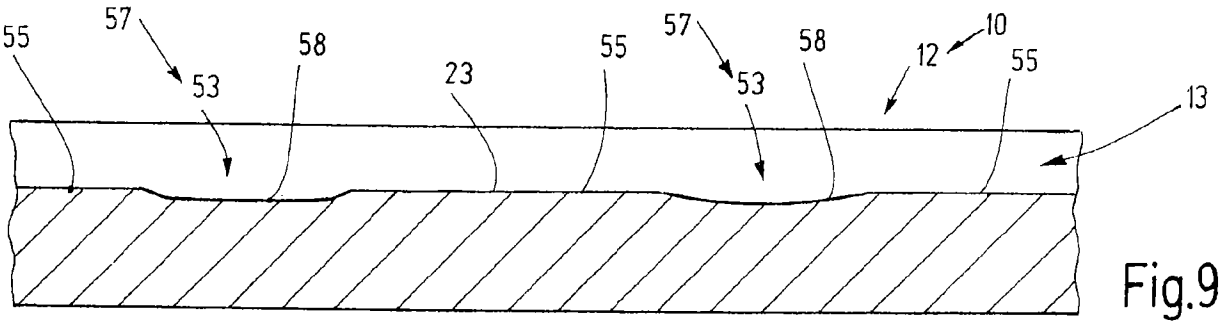
FIG. 9 is the needle bed as in FIG. 8, sectioned in the region of a guide channel.
Figure 8:
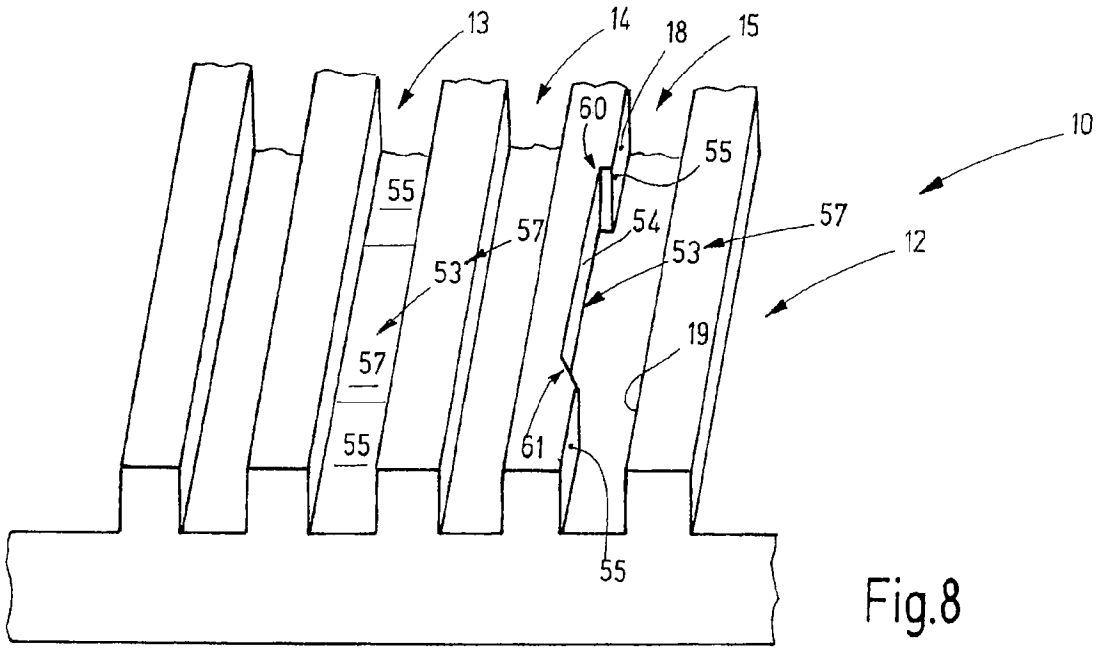
FIG. 8 is a schematic representation of a section of a needle bed.

FIG. 9 shows a detail of a needle bed 12 of a knitting device 10 in accordance with the invention. In order to reduce the contact surface and thus the friction between a knitting tool 16 and the needle bed 12, the needle bed 12 in accordance with FIG. 9 has a recess 53. This recess may be provided, for example, in the floor 23 or, alternatively, in a channel wall 18, 19 of the guide channel 13. The recess 53 may have the form of a pocket 57 with a flat bottom 58 parallel to the channel wall 18, 19 or be offset with respect to the floor 23 of the guide channel. Then the pocket 57 has a rectangular cross-sectional form. The transition region, in its narrow flat sides, extending from the bottom 58 of the pocket 57 may be angular as indicated by reference sign 60 or curved by a radius as indicated by reference sign 61. The length of the recess 53 is dimensioned in such a manner that the knitting tool 16, in the process of the formation of stitches, always abuts against at least two points 55 of the guide channel 13, 14, 15 and thus is securely guided. The depth of the recess 53 may amount to a few hundredths of a millimeter to a few tenths of a millimeter. The depth of the recess 53 may range from 0.02 mm to 0.25 mm.

As is shown by the recess 53 on the right side of FIG. 9, the bottom 58 of the recess 53 may be concave. In this case, the pocket 57 has the form of a cylindrical section. A pocket 57 having this form can be fabricated in a simple and thus cost-effective manner with the use of a circular cutting tool when the guide channel 13, 14, 15 is fabricated. The guide channel 13 of FIG. 9 has two spaced apart pockets 57 with differently formed bottoms. Next to the convexly shaped bottom (see explanation above), the bottom 58 of the pocket 57 shown on the left side in FIG. 9 has a flat surface section that is offset parallel to the floor of the guide channel 13. This flat surface section of the bottom 58 of the pocket 57 has radii terminating in the floor 23 of the guide channel 13. As is shown by FIG. 9, a guide channel 13, 14, 15 may have several recesses 53. It may also have more than two recesses 53. The recess 53 borders an abutment point 55, a knitting tool 16 abutting against said abutment point during the stitch-forming process.

Figures 10, 11, 12:
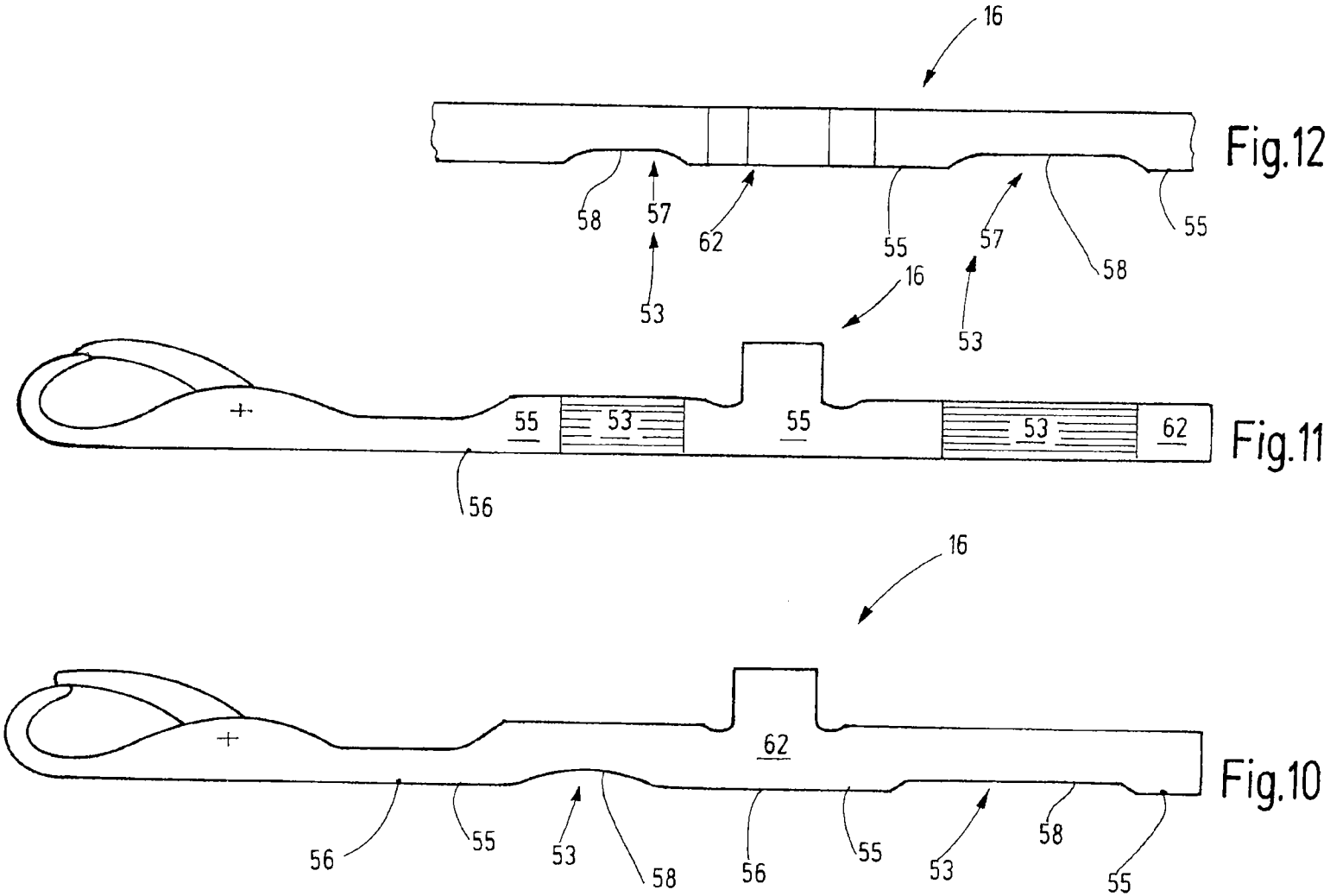
FIG. 10 is a side view of a knitting tool with recesses on the back of the knitting tool.
FIG. 11 is a side view of a knitting tool with recesses on a flat side the knitting tool.
FIG. 12 is a plan view of a detail of the knitting tool as in FIG. 11.

FIG. 10 shows a knitting tool 16 of a knitting device 10 in accordance with the invention, wherein the back 56 of the knitting tool 16 has at least one recess 53, i.e., with two recesses 53 in the exemplary embodiment in accordance with FIG. 10. The previous description of the recess 53 also applies analogously to a recess on a knitting tool 16—using the already introduced reference signs—regardless whether the recess is provided on the back 56 (FIG. 10) or on a flat side 62 (FIGS. 11 and 12) of the knitting tool 16. The recess 53 may be configured as a pocket 57 and is arranged on the knitting tool in such a manner that the back 56—should it have a recess 53—interacts with the floor 23 of the guide channel 13, 14, 15 on at least two abutment points 55 during the stitch-forming process. If the pocket-like recess 53 is arranged on the flat side 62 of the knitting tool 16, the flat side 62 has at least two abutment surfaces 55, said abutment surfaces of the knitting tool 16 abutting against a flat side 50, 51 of the guide channel 13, 14, 15 during the stitch-forming process.

During operation, the new knitting system offers a number of advantages. Due to the reduced channel depth 26 and the shank height H that is reduced compared with that of a conventional needle, a reduced mass moment of inertia of the knitting cylinder 17 is achieved. In particular, when knitting patterned goods with longer phases of reciprocating back-and-forth rotation of the knitting cylinder, this results in speed advantages. In addition, the fabrication of the knitting cylinder 17 is substantially simplified. The guide channels 13, 14, 15 may be produced with high precision and parallel flanks by ablation through machining. The complete as well as the selective hardening and/or coating of the channel walls 18, 19 and the floor 23 of the guide channel 13, 14, 15 is possible. In addition, the new geometric configuration of the needle 16, in particular in the region of its foot 35, imparts a certain torsional resilience, so that needle breakage in the foot region can be reduced despite the great longitudinal stiffness of the shank 28.

A knitting device 10 in accordance with the invention comprises a needle bed 12 and knitting tools 16, wherein the needle bed 12 is designed so as to be without joints and seams in view of the configuration of its channel walls 18, 19 as well as perpendicularly to the floor 23 of the channel through the base body 20 of the needle bed 12. The channel depth 26 of the individual guide channels 13, 14, is preferably less than three times the channel width 24. Consequently, in particular in the case of an extremely fine needle division, the resultant channel walls 18, 19 are robust, stable, and sturdy and can be subjected to a hardening or coating treatment. The reduced overall weight, the smaller friction surfaces, and the sturdier design of the knitting device enable the operation at greater knitting speeds and with greater rotational accelerations, in particular in reciprocating mode, and an overall savings of lubricants and energy.

It will be appreciated that the above description of the present invention is susceptible to various modifications, changes and modifications, and the same are intended to be comprehended within the meaning and range of equivalents of the appended claims.

LIST OF REFERENCE NUMERALS

10 Knitting device
11 Circular knitting device
12 Needle bed
13, 14, 15 Guide channel
16 Needle, knitting tool
17 Knitting cylinder
18 First channel wall
19 Second channel wall
20 Base body
21 Interior circumferential surface
22 Exterior circumferential surface, side
23 Floor
24 Channel width
25 Thickness of the channel wall 18
26 Channel depth
28 Shank
29, 30 Border
31 Hook
32 Closing element, latch
33 Stitch-forming section
34 Height
35 Foot
36 First recess
37 Second recess
38 Longitudinal direction
39 Foot direction
40 Bottom
41 Bottom
42 Needle upper side
43 Upper foot edge
44 Lower foot edge
45, 46, 47, 52 Recess
48, 49 Edge
50, 51 Flat side of the channel wall 18, 19
53 Recess
55 Abutment point
56 Back of 16
57 Pocket
58 Bottom of 57 and 53, respectively
62 Flat side of the knitting tool 16

What is claimed is:

1. Knitting device (10) comprising:

a needle bed (12) comprising a base body (20) with guide channels (13, 14, 15) provided on an exterior circumferential surface (22), wherein each guide channel (14) is delimited by two flat sides (50, 51) of two channel walls (18, 19) and a channel floor (23), wherein the channel walls (18, 19) are seamlessly connected with the base body (20) and made without joints of a same material, wherein the guide channel (14) has a channel cross-section with a channel width (24), said width to be measured from a flat side (50) of a channel wall (18) to a flat side (51) of a channel wall (19), and with a channel depth (26), said depth to be measured parallel to the channel walls (18, 19) away from the floor (23) and extending up to the exterior circumferential surface (22), and wherein the channel depth (26) is at least three quarters and at most 5 times the size of the channel width (24), a knitting tool (16) having a shank (28), said shank being arranged in the guide channel (14) so as to be shiftable in a longitudinal direction and being provided with a foot (35), said foot extending from the guide channel (14), and adjoining the foot (35), at least one recess (36) is provided on an upper side (42) of the knitting tool (16).

2. Knitting device as in claim 1, characterized in that the shank (28) has a shank cross-section that matches the channel cross-section excluding a tolerance.

3. Knitting device as in claim 1, characterized in that the shank cross-section is constant over an entire length remaining in the guide channel (14) in a driven-out state of the knitting tool (16).

4. Knitting device as in claim 1, characterized in that the recess (36) has a length to be measured in longitudinal direction (38) of the knitting tool (16), said length being at least as great as the depth to be measured perpendicularly with respect thereto and being at most as great as 20 times the depth.

5. Knitting device as in claim 4, characterized in that additional recesses (37, 45, 46, 47, 52) of a same kind are provided at a distance from the recess (36) on the needle upper side (42) of the knitting tool (16).

6. Knitting device as in claim 1, characterized in that the channel wall (18, 19) has a thickness (25) that is at least as great as the channel width (24) and that is at most as great as 1.5 times the channel width (24).

7. Knitting device as in claim 1, characterized in that the guide channel (14) is provided with a coating on the flat sides (50, 51) of its channel walls (18, 19) and on its floor (23).

8. Knitting device as in claim 1, characterized in that the channel depth (26) is one or more of: less than three times the channel width (24), greater than twice the channel width (24).

9. Knitting device as in claim 1, characterized in that the channel depth (26) is 2.62 times greater than the channel width (24).

10. Knitting device as in claim 1, characterized in that the floor (23) of the guide channel (13, 14, 15) has at least one recess (53), and/or that the flat side (50, 51) of the guide channel (13, 14, 15) has at least one recess (53), and/or that the back (56) of the knitting tool (16) has at least one recess (53).

11. Knitting device as in claim 1, characterized in that a flat side (62) of the knitting tool (16) has at least one recess (63).

12. Knitting device as in claim 11, characterized in that the recess (53) has a bottom (58) that follows a concave curvature or that has a flat form.

13. Knitting device as in claim 10, characterized in that a bottom (58) of the recess (53) is arranged offset with respect to the bottom (23) of the flat side (50, 51) of the guide channel (13, 14, 15).

14. Knitting device as in claim 10, characterized in that the bottom (58) of the recess (53) is arranged offset with respect to the back (56) or a flat side (62).

15. A knitting device comprising:

a needle bed (12) comprising a base body (20) with guide channels (13, 14, 15) provided on an exterior circumferential surface (22), wherein each guide channel (14) is delimited by two flat sides (50, 51) of two channel walls (18, 19) and a channel floor (23), wherein the channel walls (18, 19) are seamlessly connected with the base body (20) and made without joints of a same material, wherein the guide channel (14) has a channel cross-section with a channel width (24), said width to be measured from a flat side (50) of a channel wall (18) to a flat side (51) of a channel wall (19), and with a channel depth (26), said depth to be measured parallel to the channel walls (18, 19) away from the floor (23) and extending up to the exterior circumferential surface (22), and wherein the channel depth (26) is at least three quarters and at most 5 times the size of the channel width (24), wherein the guide channel (14) is provided with a metallic or ceramic hard substance coating on the flat sides (50, 51) of its channel walls (18, 19) and on its floor (23), a knitting tool (16) having a shank (28), said shank being arranged in the guide channel (14) so as to be shiftable in a longitudinal direction and being provided with a foot (35), said foot extending from the guide channel (14).

* * * * *